United States Patent [19]

Graef

[11] 4,103,878

[45] Aug. 1, 1978

[54] APPARATUS FOR REMOVING SOLIDS FROM THE WATER SEAL TROUGH OF AN ANNULAR MATERIAL COOLER

[75] Inventor: Richard W. Graef, Franksville, Wis.

[73] Assignee: Allis-Chalmers Corporation, Milwaukee, Wis.

[21] Appl. No.: 822,699

[22] Filed: Aug. 8, 1977

[51] Int. Cl.[2] ..... C21D 11/00

[52] U.S. Cl. ..... 266/78; 165/9; 266/135; 266/179; 417/179; 417/196

[58] Field of Search ..... 34/242; 165/9; 266/78, 266/179, 135; 432/2, 75; 417/179, 196

[56] References Cited

U.S. PATENT DOCUMENTS

| | | | |
|---|---|---|---|
| 3,589,691 | 6/1971 | Greaves | 266/179 X |
| 4,028,009 | 6/1977 | Gudzenko et al. | 417/179 X |

*Primary Examiner*—Roy Lake
*Assistant Examiner*—Paul A. Bell
*Attorney, Agent, or Firm*—Robert C. Jones

[57] ABSTRACT

Apparatus for removing solids such as iron oxide pellets and fines from the rotating water seal trough of an annular material cooler by periodically operating an air ejector pump, which is suspended in the trough and operated at predetermined intervals and for a predetermined time; the ejector pump has associated with it a sensing apparatus both being pivotally mounted and suspended within the trough; an abnormal build-up of pellets and fines in the trough or large foreign bodies within the trough is sensed by the sensing means which actuates emergency means to override the normal pump operating cycle and maintain the pump operating and simultaneously alerting personnel to the emergency condition.

11 Claims, 6 Drawing Figures

APPARATUS FOR REMOVING SOLIDS FROM THE WATER SEAL TROUGH OF AN ANNULAR MATERIAL COOLER

BACKGROUND OF THE INVENTION

This invention relates to apparatus for maintaining the integrity of a water trough gas seal and more particularly to apparatus for removing solids from the annular water trough to maintain the water depth in the trough at a desired gas sealing depth and to maintain the heat transfer ability of the water.

The invention is susceptible to application of water sealing means associated with various apparatuses; it will be discussed in connection with an annular cooler chamber associated with a pelletizing system.

In the production of heat hardened pellets of iron-oxide materials, the beneficiated ore concentrate is processed through a kiln system and thereafter cooled so that they may be handled for shipping or storage.

Kiln systems which include straight line coolers have been commercially in use for many years. More recently kiln systems having annular coolers, in which the pellets are cooled in an enclosed circular grate structure wherein the hot gases given off by the pellets are reclaimed and recycled as secondary air within the kiln system, have been introduced and are in demand. In annular coolers the interior of the cooler is at a lower pressure than atmospheric pressure during normal operation. Thus, the ambient atmospheric air is normally urged to enter the enclosure or hood thereby defeating the recycling process.

To overcome this problem, annular channel-shaped water filled sealing means have been developed, as exemplified in U.S. Pat. Nos. 3,460,818 and 3,589,691. In these patents the problem of sediment deposit in the water seal troughs was recognized and an attempt made to minimize such deposits by providing a leveler which traveled with the movable barrier. However, with the arrangement disclosed in the aforementioned patents, periodic shutdown of the kiln system is necessary to remove accumulated sediment deposits or, in lieu of complete cleaning of the troughs, manual syphoning or scooping of the sediment deposits would be attempted. Manual syphoning removes a large amount of water from the trough which is either wasted or requires additional separator equipment and pumps to reclaim the water. Manual syphoning requires that the solids or sediment layer in the water seal trough must be allowed to build up to allow for syphoning. This build-up of solids in the trough reduces heat transfer from the sides of the trough to the water.

SUMMARY OF THE INVENTION

Apparatus and method are provided according to the present invention to overcome the disadvantages of prior devices and to provide additional advantages. The present invention removes a relatively small amount of water as air and solids occupy most of the volume removed. In addition, the bottom of the water seal trough is maintained relatively clean at all times thereby retaining the good heat transfer relationship between the metallic trough and the water. Little make-up water is required thereby reducing the operating cost, and solids are easily conveyed from the trough elevation to a convenient load-out point.

The solids removal arrangement herein disclosed includes an ejector pump and an associated dam assembly arranged to remove accumulated solids that have settled to the bottom of the trough. When the drag from the accumulated solids in the trough reaches a predetermined force, the dam assembly and pump are displaced. Displacement of the dam assembly from its normal operating position overrides the normal operating cycle of the associated ejector pump so that it operates constantly and actuates an emergency alarm. When the solids are exhausted from the trough, the dam assembly returns to its normal operating position and deactivates the ejector pump. The operation is entirely automatic so that the water seal trough is maintained relatively free of solids to thereby maintain good heat transfer and also a satisfactory water depth for an efficient gas seal.

DESCRIPTION OF THE INVENTION

Figure 1:
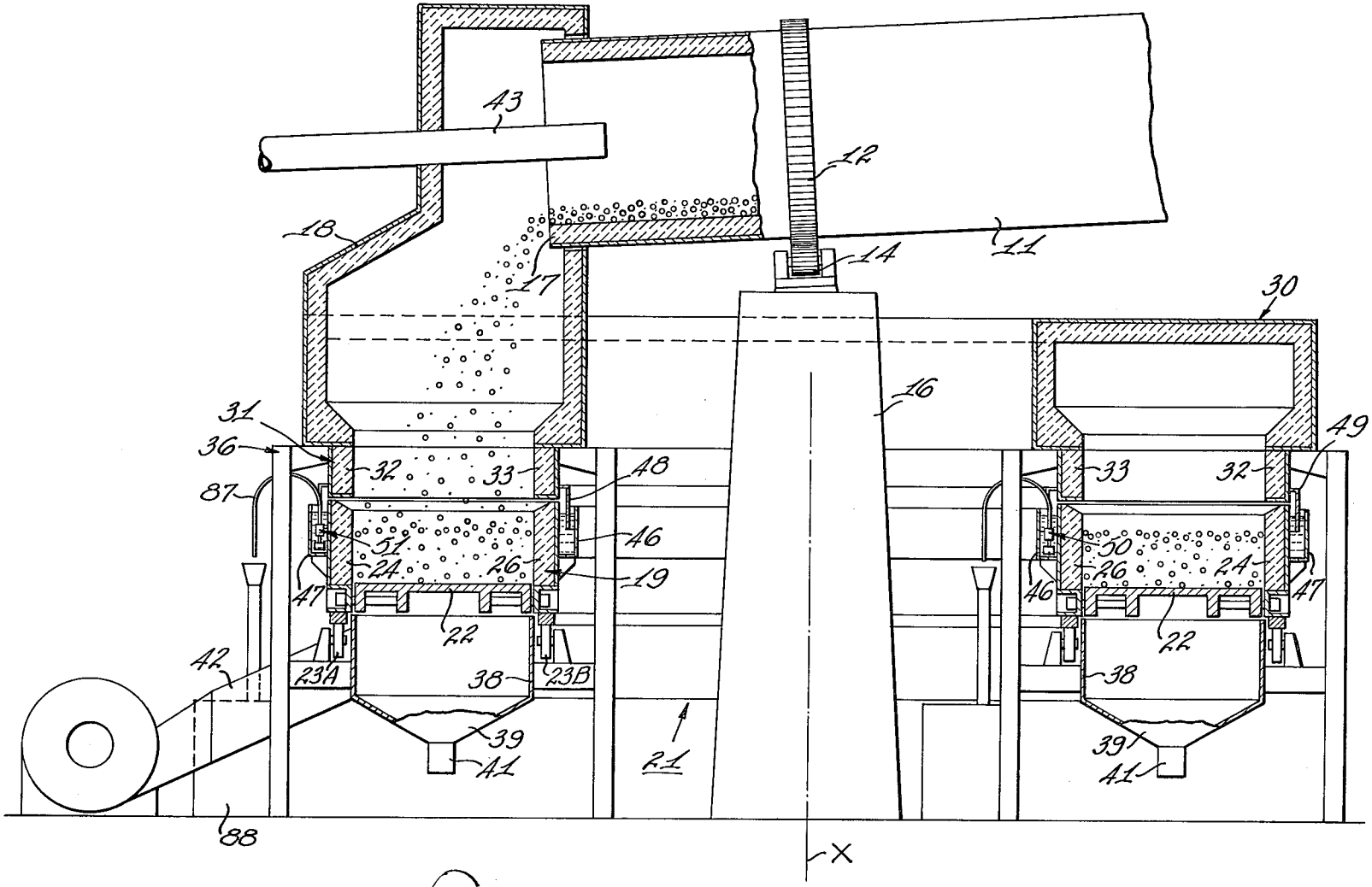
FIG. 1 is a view of a kiln system partly in elevation and partly in vertical section showing the lower end of the kiln feeding into an associated annular cooler in which the present invention is incorporated.

As shown in FIG. 1, the kiln system includes a kiln 11 which is supported for rotation by riding rings 12, one of which is shown, rolling on roller supports 14 mounted on the top of a pier 16. The discharge end 17 of kiln 11 extends into a cooler loading hood 18 which in turn communicates with grate 19 of the annular cooler 21. Grate 19 is adapted to rotate about an axis X in a circular path which, in the particular illustration, coincides with the axis of pier 16. The grate 19 comprises a plurality of gas permeable hearth plates 22 supported for circular movement on rollers 23A and 23B. The grate 19 also includes upstanding gas impermeable side walls 24 and 26 which extend entirely around the outer and inner circumference of the grate. The construction defines a grate which in cross section is generally channel-shaped configuration. Superimposed over the grate 19 is a circular stationary refractory lined hood 30 which at the location of the charging hood 18 is interrupted to accommodate the communicating of the charging hood with the grate 19 while maintaining the gas confining integrity of the hood 30. The cross-sectional configuration of the lower portion of hood 30 adjacent the grate 19 closely conforms to the cross-sectional configuration of the grate. Thus, the lower portion 31 of the circular hood has side walls 32–33 which closely approach the upper edges of the grate side walls 24–26, respectively. The hood 30 is supported in stationary position by the frame 36.

A stationary wind box 38 extends in a circular path directly under the grate 19. At spaced locations the wind box 38 has depending portions 39 for the accumulation of fines discharging the collected dust through traps 41. Air is introduced into the wind box 38 by means of a fan connected to the wind box by duct 42. The air passes up through the material bed cooling the material. The hot gases given off in the cooling process are recycled into the kiln 11 to supplement the heat from the kiln burner 43.

Sealing means for sealing the joint space between the stationary hood 30 and the revolving grate 19 against the escape of gases or the entry into the system is accomplished by two stationary water troughs 46 and 47. The troughs 46 and 47 are positioned on the inside and outside of the grate 19, respectively, and extend entirely around the I.D. and O.D. of the grate. Water at a suitable level is maintained in each trough and this water level can be maintained automatically by conventional well-known means. Downwardly extending shield walls 48 and 49 are secured in gas tight relationship to the lower portion 31 of the stationary hood 30 and extend into the water in the associated troughs 46 and 47, respectively. Thus, as the grate rotates at the rate of about 1.5 revolutions per hour the shield walls 48–49 remain stationary and submerged effectively providing a gas seal.

However, it has been found that pellets, fines, chips and other solids enter the water troughs. It has also been found that larger foreign bodies, either inadvertently or otherwise, have been found in the troughs. The accumulation of solids in the trough impair both the efficiency of the water seal and reduce the heat transfer efficiency of the water against the sides of the grate. To remove such solids, the solids are accumulated at a point within the troughs and removed manually or as set forth in U.S. Pat. No. 3,460,818 and accumulated on a removable tray which is manually removed for cleaning. However, both these methods have not been satisfactory as both require strict attention from the operator or the maintenance personnel.

Figure 3:
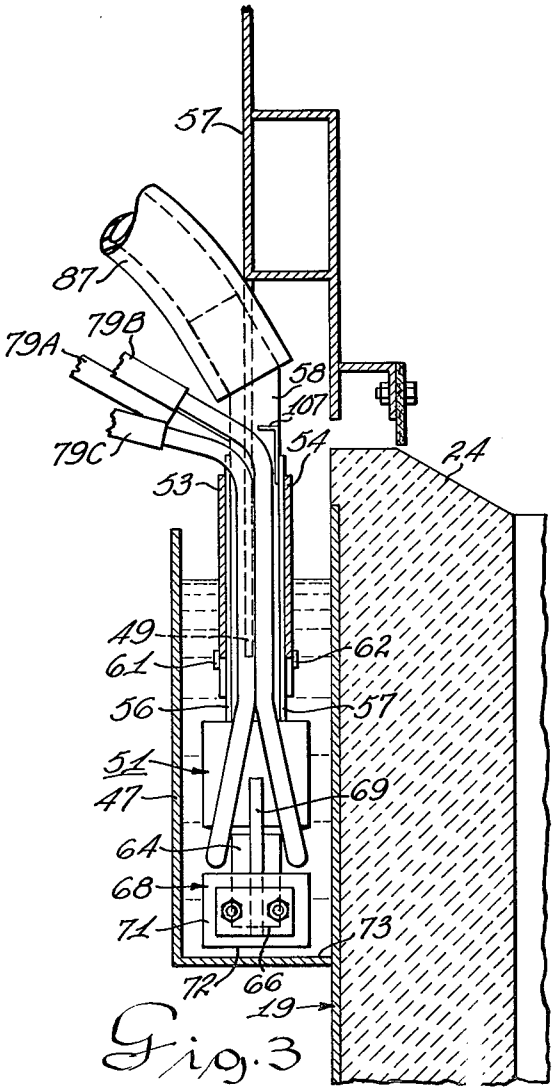
FIG. 3 is a view in elevation taken in a plane represented by the line III—III in FIG. 2 showing the dam assembly in normal operating position.
Figure 2:
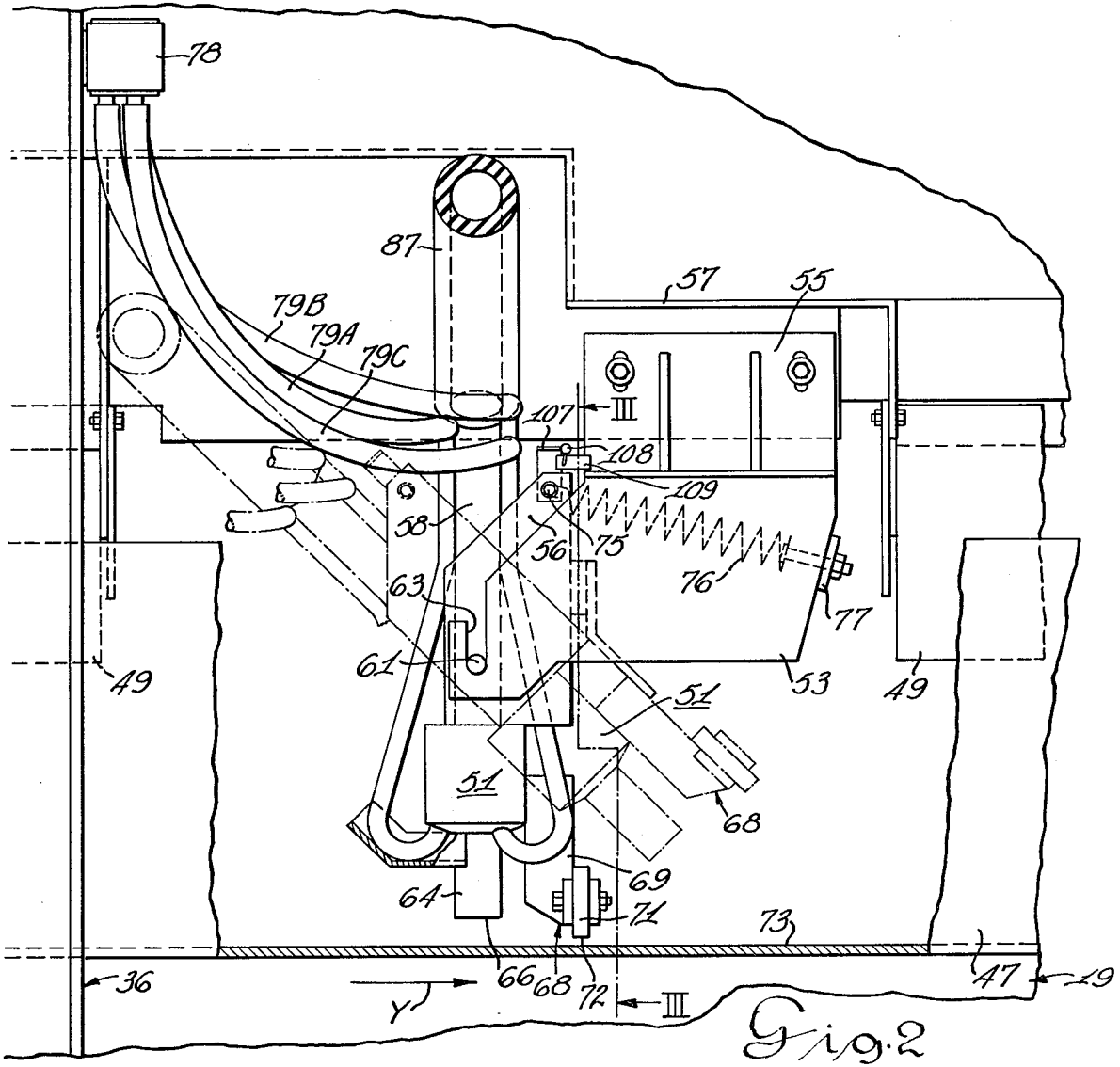
FIG. 2 is an enlarged fragmentary view in side elevation of a solid removal system within the inner water seal trough, the side of the trough being broken away to show the apparatus.
Figure 5:
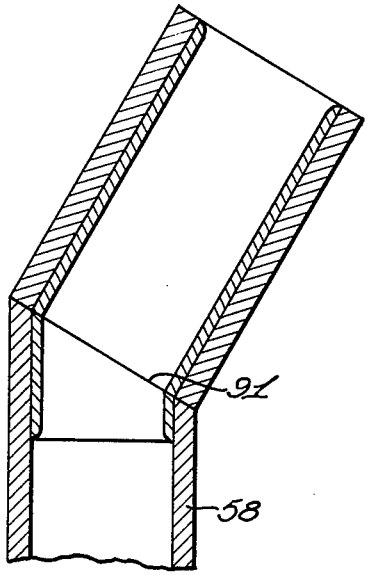
FIG. 5 is an enlarged fragmentary view of the upper portion of the ejector pump outlet showing the internal arrangement.

The present invention sets forth an automatic trough cleaning system which is efficient and removes a relatively small amount of water as the solids are removed. To this end, ejector pumps 50–51 are disposed to be immersed within the troughs 46–47, respectively, and operate when actuated to syphon solids from the bottom of the respective troughs. The ejector pumps 50 and 51 are identical and a description of the ejector pump 51 arrangement will also be applied to the arrangement of ejector pump 50. As best shown in FIGS. 2 and 3, the ejector pump 51 is pivotally suspended in the trough 47 between spaced apart plates 53–54. The plates 53–54 are, in turn, secured in depending relation from an L-shaped bracket 55 which is adjustably secured to a frame 57. To provide the pivotal support for the ejector pump 51, a pair of side plates 56 and 57, FIG. 3, are welded to the discharge pipe 58 of the ejector pump 51. A pair of oppositely extending pivot studs 61–62 are welded to the plates 56–57, respectively. These studs 61–62 are received in vertical slots formed in the leftwardly extending end of plates 53–54 as viewed in FIG. 2, the slot 63 associated with the plate 53 being shown. The normal operating position of the ejector pump 51 being vertical with an intake 64 having an inlet nozzle 66 of the pump positioned within a relatively short distance of the bottom of the trough 47. Attached to the body of the ejector pump 51 is a dam assembly 68 which operates to sense an extremely large build-up or deposit of solids on the bottom of the trough or to sense the presence of other larger foreign bodies such as bars, tools or the like. As can be seen in FIG. 2, the dam comprises a hanger bar 69 which is welded to the ejector pump body. The lower end of the hanger bar 69 supports a transversely extending plate 71, the bottom edge 72 of which is positioned so as to be closer to the bottom surface 73 of the trough 47 than the nozzle of the intake 66. The preferred relationship is 3:1 and, as shown, the edge 72 is about $\frac{1}{2}$ inch above the surface 73 while the nozzle 66 is positioned $1\frac{1}{2}$ inches from the surface. This arrangement provides for the required vacuum in the lower portion of the bore 82, FIG. 4.

For maintaining the ejector pump and dam assembly in normal vertical yieldable operating position there is provided a yieldable means herein shown as a tension spring 76. The spring 76 has one end adjustably secured to a transverse strap 77 which is secured to the right-hand ends, as viewed in FIG. 2, of the plates 53–54. The opposite end of the spring 76 is connected to a bolt 75 that extends between the plates 56–57 which are welded to the outlet pipe 58 of the pump. Thus, both the ejector pump 51 and the dam assembly are yieldably maintained in upright vertical operating position but both will yield, pivoting about the studs 61–62 in a counterclockwise direction. In FIG. 2, the direction in which the trough 47 moves is rightwardly as indicated by the directional arrow Y. In normal operation, the dam assembly 71 causes a predetermined build-up of solids in the area of the ejector pump intake which provides for a more efficient operation of the pump. However, an unusual build-up of solids in the trough or the presence of a larger foreign body such as a tool or bar will cause the ejector pump and dam assembly to pivot to an inoperative position to prevent damage thereto and to initiate an alarm system which alerts operating personnel to the condition.

Figure 4:
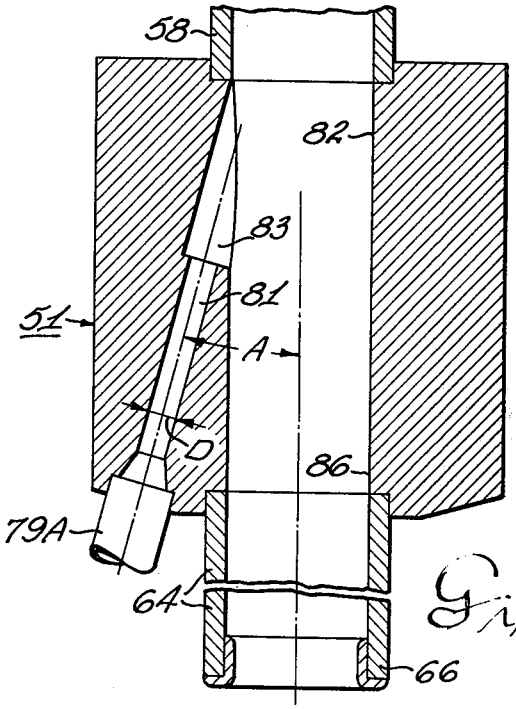
FIG. 4 is a section through the ejector pump showing the main bore and one of the jet bores and the relationship therebetween.

As previously mentioned, the ejector pump 51 is operated by air under pressure from a suitable source (not shown) as a pump or the like. This air pressure source is connected to the ejector pump through a normally closed solenoid actuated air valve 78 mounted on the frame. Three flexible conduits 79A–79B and 79C connect the valve 78 to three bores which are identical, a single jet bore 81 being shown in FIG. 4. As shown in FIG. 4, the ejector pump 51 is provided with a main central bore 82 which is coaxial with the axis of the pump body. The side jet bores 81 are formed from the lower end of the ejector pump and equally spaced 120° apart. The diameter of each of the jet bores 81 is such that the area of the main bore 82 is $6\frac{1}{4}$ times the area of a single jet bore diameter. The preferred construction of the ejector pump 51 is such that the diameter of the main bore 82 is 1 15/16 inches. The angular relationship A between the axes of the jet bores 81 and the axis of the main bore 82 is 15° . Also, the diameter D of each jet bore 81 is 0.410 inches. With this relationship, the velocity of air passing through each jet bore provides a volume of air to create a vacuum in the outlet bore to evacuate iron pellet solids from the trough 47. As can be seen, the jet bores as exemplified by bore 81 communicate with a counterbore of $\frac{5}{8}$ inch diameter. The counterbore 83 communicates with the main bore 82. The volume of pressure air through the jet bores 81 is sufficient to create a vacuum in the lower portion 86 of the main bore 82 to draw solids into the ejector pump intake 64 and into the upwardly moving air pressure stream which exits through the outlet bore 58. The outlet of the bore 58 has a connection with a conduit 87 which communicates with a suitable receptacle indicated as a bin 88 in FIG. 1.

To reduce the abrasive effect of the solids on the inlet tip of the inlet nozzle 66, the nozzle is hardened. In like manner, the inner surface of the outlet 58, in the area 91 wherein it changes direction, is hardened. With this construction, the areas most subjected to an abrasive action of the solids are protected.

Figure 6:
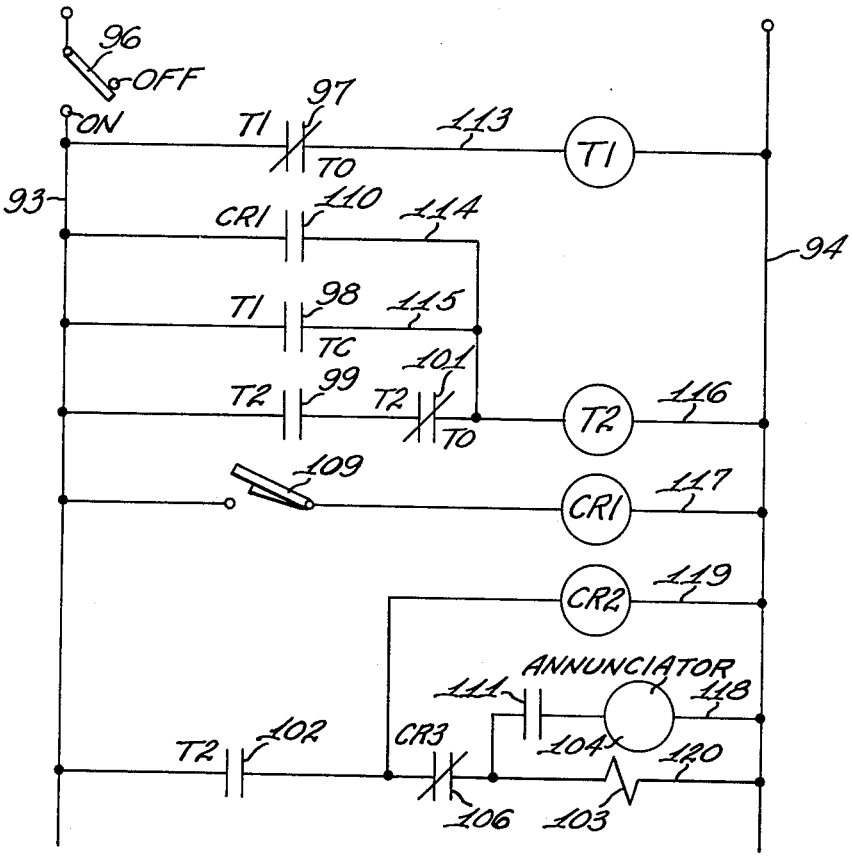
FIG. 6 is an electrical diagram associated with one ejector pump.

In FIG. 6, an electrical control circuit for actuating the solenoid valve 78 and thereby controlling the operation of the pump is shown. The electrical components are wired across power lines 93–94 and include a manually positionable on-off switch 96. The power lines 93–94 are energized from a source (not shown) in the usual well known manner. With the switch 96 in closed position, control of the ejector pump 51 is automatic. Thus, a solenoid of a timer relay T1 in horizontal line 113 is energized through an associated normally closed time-to-open contact 97. The timer relay T1 is set to time out 30 minutes after the energization of its solenoid. Thus, when the timer relay T1 operates after its preset time expires, an associated normally open contact 98 in line 115 is closed. This establishes a circuit to energize the solenoid of a timer relay T2 in line 116. The timer relay T2 is set to operate ½ minute after its associated solenoid is energized. When T2 operates, an associated instantaneous normally open contact 99 in line 116 closes. This establishes a circuit along line 116 through an associated normally closed time-to-open contact 101 associated with the timer relay T2. Thus, timer relay T2 is operated and after its preset time of ½ minute expires it will deenergize and contact 99 will open and contact 101 will close for a subsequent cycle.

When T2 operates, another associated instantaneous normally open contact 102 in line 120 is closed. This establishes a circuit along line 120 to energize a solenoid 103 associated with the valve 78 to operate the valve. When the valve 78 operates, air under pressure is supplied to the ejector pump 51 for effecting the removal of solids from the trough 47.

To prevent the ejector pump 50 from operating when the ejector pump 51 is operating, a lock-out arrangement is provided. To this purpose at the time contact 102 in line 120 is closed a circuit is also established to energize the solenoid associated with a relay CR2 in line 119. When the relay CR2 operates, an associated normally closed contact (not shown) similar to the normally closed contact 106 in line 120 is opened. Thus, the solenoid (not indicated) associated with an air valve in circuit relationship with ejector pump 50 cannot be energized and the pump 50 cannot operate.

In a similar manner, when ejector pump 50 is operating the normally closed contact 106 is in open condition because its associated relay in the control circuit of ejector pump 50 is deenergized. The interlocking of the ejector pumps in a manner that only one of them can operate at a time reduces the demand on the system air supply. Thus, a smaller air system can be utilized.

As previously mentioned, if an unusual build-up of solids occurs in the trough 47 or large foreign bodies have entered the trough 47, the ejector pump 51 and dam assembly 68 will pivot in a counterclockwise direction as viewed in FIG. 2. When the dam assembly 68 is pivoted into an inoperative position indicated by the dash-dot line position in FIG. 2, a dog 107 affixed to the upper portion of the pivot bracket or plate 57 is moved out of engagement with an actuating lever 108 of a limit switch 109 that is mounted on bracket 55. Thus, the limit switch 109 is released to a closed position and, as shown in FIG. 6, completes a circuit to the solenoid of a CR1 relay in line 117. When the relay CR1 operates, an associated normally open contact 110 in line 114 is closed. This establishes a maintaining circuit around the contact 99 in line 116 to maintain the solenoid of relay T2 energized and thereby maintains the valve solenoid 103 energized. Thus, the ejector pump is maintained in operating condition.

Simultaneously with the operation of the contact 110, another associate contact 111 in line 118 is operated to energize an annunciator 104 to alert personnel to the fact that the ejector pump 51 is operating in emergency mode.

The embodiments of the invention in which an exclusive property or privilege is claimed are defined as follows:

1. In an annular material cooler device having at least one gas seal water trough, an apparatus for removing solids from said water trough comprising;

an ejector pump mounted in said water trough having a body portion provided with a main bore having an inlet and an outlet, said inlet being immersed in the water of the water trough;

a source of air under pressure;

conduit means connecting said source of air under pressure to said ejector pump; and control means operable when actuated to direct the air under pressure to said ejector pump to create a vacuum at the inlet thereof to draw solids from the water trough into said ejector pump and into the stream of air under pressure passing through said ejector pump to be expelled therefrom through said outlet.

2. An apparatus according to claim 1 wherein the solids are iron oxide materials in the form of pellets and fines.

3. An apparatus according to claim 2 wherein said control means includes an air valve selectively actuated to direct air pressure to said ejector pump.

4. An apparatus according to claim 3 in which said air valve is connected to said ejector pump with a plurality of conduits.

5. An apparatus according to claim 1 in which said body portion is provided with a plurality of jet bores connected to said source of air under pressure by said conduit means, said jet bores having communication with said main bore above said inlet wherein the inrush of air under pressure through said jet bores and into said main bore creates a vacuum at the inlet of said main bore to draw the solids out of the trough into the air stream flowing out of the ejector pump through said outlet.

6. An apparatus according to claim 5 wherein said jet bores are spaced equidistance apart around the axis of said main bore with the axis of each jet bore intersecting the axis of said main bore at the same point.

7. An apparatus according to claim 6 wherein the axes of said jet bores are at an angle of 15° with respect to the axis of said main bore; and a conduit connected to the inlet end of said main bore and having a free end, the free end of said conduit being not more than 12 inches from the point at which the axes of said jet bores intersect the axis of said main bore.

8. An apparatus according to claim 7 in which the length of each jet bore in said body portion is $6\frac{1}{4}$ times the diameter of said jet bore.

9. An apparatus according to claim 1 in which said control means operates to cycle the operation of said ejector pump automatically at predetermined intervals for a predetermined length of time.

10. An apparatus according to claim 9 wherein said control means includes sensing means operable to sense an abnormal condition within said trough;

emergency means operable in response to said sensing means sensing an abnormal condition in said trough to override said cycle of ejector pump operation and to maintain said ejector pump operating; and, alerting means operated by said emergency means to indicate that said ejector pump is operating under emergency conditions.

11. An apparatus according to claim 10 wherein said ejector pump and said sensing means are yieldably supported in operating position within the trough and yield under an abnormal condition to an inoperative position wherein said emergency means is actuated.

* * * * *